US005193371A

United States Patent [19]

Yamane

[11] Patent Number: 5,193,371

[45] Date of Patent: Mar. 16, 1993

[54] MAGNET CARD TYPE LOCK

[75] Inventor: Shinjiroh Yamane, Kawasaki, Japan

[73] Assignee: Kabushiki-Kaisha, Tokyo, Japan

[21] Appl. No.: 813,015

[22] Filed: Dec. 24, 1991

[51] Int. Cl.[5] ..... E05B 47/00

[52] U.S. Cl. ..... 70/276; 70/413

[58] Field of Search ..... 70/276, 278, 279, 413

[56] References Cited

U.S. PATENT DOCUMENTS

| | | | |
|---|---|---|---|
| 2,931,953 | 4/1960 | Barney | 70/413 X |
| 3,584,484 | 6/1971 | Hallmann et al. | 70/413 X |
| 3,654,782 | 4/1972 | Heimann | 70/413 X |
| 3,660,999 | 5/1972 | Janzen | 70/276 |
| 3,855,827 | 12/1974 | Hallmann et al. | 70/413 X |
| 3,995,460 | 12/1976 | Sedley | 70/413 X |
| 4,133,194 | 1/1979 | Sedley et al. | 70/276 X |
| 4,932,228 | 6/1990 | Eisermann | 70/413 X |
| 5,074,136 | 12/1991 | Kim et al. | 70/276 |

FOREIGN PATENT DOCUMENTS

| | | | |
|---|---|---|---|
| 66224 | 9/1975 | Australia | 70/413 |
| 531433 | 8/1955 | Italy | 70/413 |

*Primary Examiner*—Renee S. Luebke
*Assistant Examiner*—Suzanne L. Dino
*Attorney, Agent, or Firm*—Wenderoth, Lind & Ponack

[57] ABSTRACT

A magnet card type lock includes an outer case, a slider having a key hole slit formed therein, an engagement member firmly secured to the outer case, a plurality of tumbler holes formed in conformity with a predetermined pattern of arrangement, a plurality of magnet tumblers bridged between the case and the slider, a projection integrated with the slider to be engaged with a locking mechanism and a magnet card adapted to be inserted into the key hole slit of the slider to serve as a fellow key. To prepare a specific key difference among a number of magnet card type locks, a predetermined number of tumbler holes are selected from the tumbler holes which extend at a substantially right angle relative to the slider and the outer case. The magnet card is formed with a pluraltiy of apertures some of which are immovably filled with permanent magnets corresponding to the selected number of tumbler holes. When the magnet card is inserted into the key hole slit of the slider, the magnet tumblers are displaced away from the bridged state so as to allow the slider to be pushed in the downward direction, whereby the lock is released from the locked state. A projection plate including a projection may be slidably inserted between the slider and the case. In this case, a plurality of magnet tumblers and a plurality of pin tumblers are received in the selected number of tumbler holes.

4 Claims, 5 Drawing Sheets

MAGNET CARD TYPE LOCK

BACKGROUND OF THE INVENTION

1. Field of the Invention

The present invention relates generally to a magnet card type lock. More particularly, the present invention relates to an improvement of the magnet card type lock which assures that the lock is constructed with smaller dimensions and that a locking/unlocking operation can be performed easily and conveniently.

2. Description of the Related Art

A conventional magnet card type lock is constructed in the form of a bank lock as disclosed in for example, Japanese Unexamined Patent Publication (Kokai) NO. 59-173473. This bank lock includes a plurality of magnet tumblers arranged on a common plane so that an unlocking operation is performed by magnetic engagement of permanent magnets on a magnetic card with the magnet tumblers and a locking operation being performed by magnetic disengagement of the former from the latter.

Generally, the conventional magnet card type lock includes a movable member adapted to be engaged with the magnet tumblers in the same manner as the aforementioned bank lock. When a magnet card is inserted into a key hole slit, the movable member is disengaged from the magnet tumblers. Subsequently, the movable member is actuated by a user's fingers so as to unlock a hook or the like which is operatively associated with the movable member.

However, with respect to the conventional magnet card type lock constructed in the above-described manner, it has been found that it has a drawback that it can not practically be employed for a small lock to be equipped on, e.g., a trunk case or the like, since the movable member including a large hook portion is a necessary part of the lock, resulting in the magnet card type lock being designed and constructed in large dimensions.

In addition, since a considerably large magnitude of force given by the user's fingers is exerted directly on the magnet tumblers for bringing the movable member into an unlocked state, another drawback of the conventional magnet card type lock is that the lock is easily broken. In other words, the conventional magnet card type lock provides a low resistance to a violent and malicious unlocking or breaking of the lock with a persons's hands.

Additionally, since two operations, i.e. insertion of the magnet card and actuation of the movable member are required for performing the locking and unlocking operations, or at least for performing the unlocking operation, another drawback of the conventional magnet card type lock is that it is inconvenient to use.

SUMMARY OF THE INVENTION

The present invention has been made in consideration of the foregoing background.

An object of the present invention is to provide a magnet card type lock which makes it possible to design and construct the lock with smaller dimensions.

Another object of the present invention is to provide a magnet card type lock which assures that a locking-/unlocking operation can easily and conveniently be performed without any special skill.

According to one aspect of the present invention, there is provided a magnet card type lock which comprises a box-shaped outer case of which one surface is opened and exposed to the outside; a slider having a key hole slit formed therein of which a lower end is closed with a bottom wall thereof, the slider being telescopically slidably received in the outer case and normally biased by a spring means towards a position projecting outward of the outer case; an engagement member firmly secured to the outer case so as to hold the slider at a predetermined position in the outer case while the engagement member is firmly fitted to the outer case from the opened side of the same; a plurality of tumbler holes formed in conformity with a predetermined of arrangement pattern on a slidable surface between the slider and the outer case serving as a shear line, the tumbler holes extending at substantially a right angle relative to the shear line while the opposite ends of the tumbler holes are kept closed; a plurality of magnet tumblers received in some tumbler holes selected from the plurality of tumbler holes, the magnet tumblers being bridged between the slider and the outer case with the shear line located therebetween while the magnet card type lock is usually held in a locked state; a projection integrated with the slider while projecting outward of the same so as to be engaged with a locking mechanism; and a magnet card adapted to be inserted into the key hole slit of the slider to serve as a fellow key, the magnet card being formed with a plurality of apertures some of which are immovably filled with permanent magnets corresponding to the selected number of tumbler holes in which the magnet tumblers are received, the permanent magnets being located in alignment with the magnet tumblers when the magnet card is inserted into the key hole slit of the slider while the opposite sides of the permanent magnets and the magnet tumblers are magnetized with the same magnetic pole; whereby when the magnet card is inserted into the key hole slit of the slider, the magnet tumblers are displaced to the outer case side past the shear line by the magnetic repulsive force appearing between the permanent magnets and the magnet tumblers.

It is preferable that a tumbler cover having an inverted L-shaped sectional contour is immovably placed on the outer case to close the outer ends of all the tumbler holes therewith.

The respective magnet tumblers are normally biased toward the slider by springs which are received between the tumbler cover and the magnet tumblers.

In addition, it is preferable that a part of each tumbler hole formed on the slider is dimensioned to have an inner diameter slightly larger than that of each tumbler hole formed on the outer case.

With the magnet card type lock constructed in the above-described manner, when the magnet card is inserted into the key hole slit of the slider, the permanents magnets on the magnet card are located in alignment with the magnet tumblers. This causes a magnetic repulsive force to appear between the permanent magnets and the magnet tumblers with the result that only the magnet tumblers are moved away from the permanent magnets against the resilient force of the springs, because the permanent magnets are immovably held on the magnet card. Consequently, the magnet tumblers are retracted in the selected number of tumbler holes on the outer case side from the initial locked state in which they are bridged between the slider and the outer case.

While the foregoing positional state is maintained, the slider is released from the engaged state relative to the outer case. Thus, as the magnet card is squeezed further in the direction of insertion, the slider is increasingly slidably displaced in the slit of the outer case, causing the projection integrated with the slider while projecting outward of the outer case to be displaced together with the slider. Consequently, the locking mechanism is controllably actuated by displacing the projection in that way. Namely, the locking mechanism is released from the locked state.

When user takes out his magnet card from the key insert slit of the slider after completion of the unlocking operation, the slider is restored to its original position by the action of the springs.

If a different kind of magnet card failing to serve as a fellow key or other card-shaped member other than the magnet card is inserted into the key hole slit of the slider by another person for the purpose of maliciously unlocking or breaking the lock, at least one magnet tumbler is still bridged between the slider and the outer case with the shear line located therebetween. Thus, since the slider is not displaced further no matter how it is pushed further in the direction of insertion, and naturally, the projection is not likewise displaced further, the locking mechanism can not be further actuated.

In addition, according to another aspect of the present invention, there is provided a magnet card type lock which comprises a box-shaped outer case of which one surface is opened and exposed to the outside; a slider having a key hole slit formed therein of which a lower end is closed with a bottom wall thereof, the slider being telescopically slidably received in the outer case and normally biased by spring means toward a position of projecting outward of the outer case; an engagement member firmly secured to the outer case so as to hold the slider at a predetermined position in the outer case while the engagement member is firmly fitted to the outer case from the opened side of the same; a projection plate slidably inserted between the outer surface of the slider and the inner wall surface of the outer case with a projection projected outward of one end of the outer case so as to be engaged with a locking mechanism, slidable movement of the projection plate being guided independently of the outer case and the slider in the same direction as that of slidable movement of the slider; a plurality of tumbler holes formed in conformity with a predetermined pattern of arrangement over a slidable surface between the slider and the projection plate serving as a first shear line as well as a slidable surface between the projection plate and the outer case serving as a second shear line, the tumbler holes extending at substantially a right angle relative to the first shear line and the second shear line while opposite ends of the tumbler holes are kept closed; a plurality of magnet tumblers received in some tumbler holes selected from the plurality of tumbler holes, the magnet tumblers being normally biased toward the key hole slit of the slider by spring means; a plurality of pin tumblers received in the selected tumbler holes behind the magnet tumblers as seen from the slider side, the pin tumblers being normally biased toward the key hole slit of the slider by spring means; a contact surface between the magnet tumblers and the pin tumblers being correctly aligned with the first shear line while the magnet card type lock is usually held in a locked state; and a magnet card adapted to be inserted into the key hole slit of the slider to serve as a fellow key, the magnet card being formed with a plurality of apertures some of which are immovably filled with permanent magnets corresponding to the selected number of tumbler holes in which the magnet tumblers and the pin tumblers are received, the permanent magnets being located in alignment with the magnet tumblers when said magnet card is inserted into the key hole slit of the slider while the opposite sides of the permanent magnets and the magnet tumbler are magnetized with the same magnetic pole; whereby when the magnet card is inserted into the key hole slit of the slider, the magnet tumblers and the pin tumblers are displaced away from the magnet card by the magnetic repulsive force appearing between the permanent magnets and the magnet tumblers so that the contact surface between the magnet tumblers and the pin tumblers is brought in alignment with the second shear line while the magnet tumblers are held in the tumbler holes on the projection plate and the slider and the pin tumblers are held in the tumbler holes on the outer case.

Similar to the magnet card type lock according to the former aspect of the present invention, it is preferable that a tumbler cover having an inverted L-shaped sectional contour is immovably placed on the outer case to close the outer ends of all the tumbler holes therewith.

In addition, it is preferable that a part of each tumbler hole formed on the projection plate and the slider is dimensioned to have an inner diameter slightly larger than that of each tumbler hole formed on the outer case.

Since operation and function of the magnet card type lock according to the latter aspect of the present invention are basically same as those of the magnet card type lock according to the former aspect of the present invention, repeated description will not be required.

Other objects, features and advantages of the present invention will readily become apparent from a reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
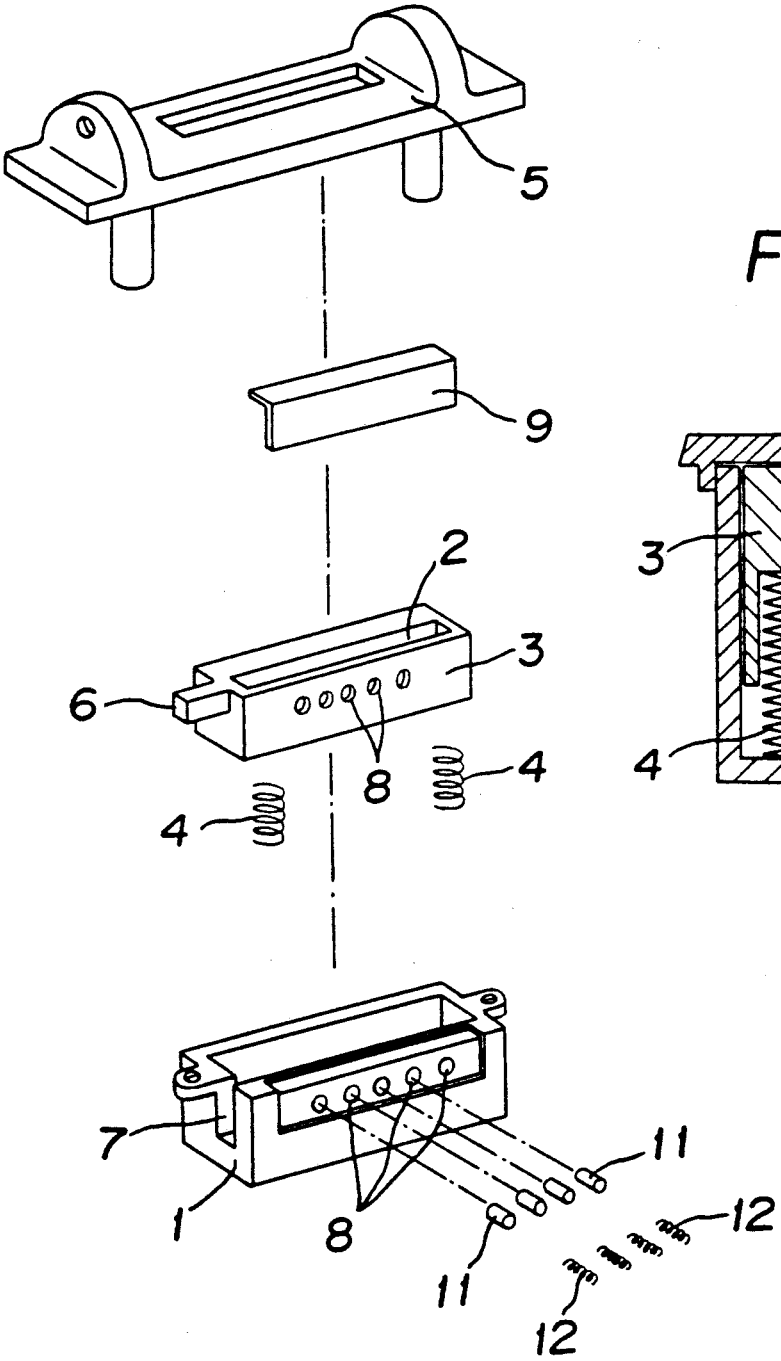
FIG. 1 is an exploded perspective of a magnet card type lock in accordance with a first embodiment of the present invention, particularly illustrating essential components constituting the lock in a disassembled state.
Figure 2:
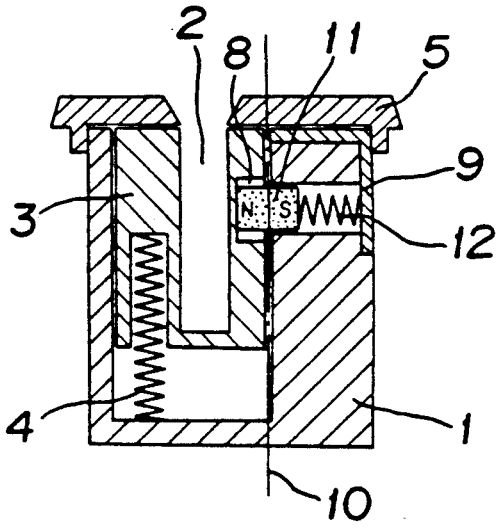
FIG. 2 is a vertical sectional view of the magnet card type lock shown in FIG. 1, particularly illustrating the lock in a locked state.

FIG. 1 and FIG. 2 illustrate the structure of a magnet card type lock in accordance with a first embodiment of the present invention wherein FIG. 1 is an exploded perspective view of the lock, particularly illustrating essential components constituting the lock in a disassembled state, and FIG. 2 is a sectional view of the magnet card type lock. In the drawings, reference numeral 1 designates a box-shaped outer case of the magnet card type lock of which one surface is opened and exposed to the outside.

A block-shaped slider 3 having a lock hole slit 2 formed therein is slidably inserted into a cavity of the outer case 1. It should be noted that the lower end of the key hole slit 2 is closed with a bottom wall of the slider 3.

As is best seen in FIGS. 1 and 2, the slider 3 is normally biased in the upward direction as seen in the drawing with the aid of slider springs 4 in the form of compression springs which are received in the cavity of the outer case 1.

In addition, the magnet card type lock includes a decorative plate 5 which is firmly placed on the outer case 1 while closing the cavity of the case 1 therewith. The decorative plate 5 is formed with a slit which is aligned with the lock hole slit 2 of the slider 3 while having the same dimensions as those of the lock hole slit 2. Arrangement of the slit permits the slider 3 to be inserted into the cavity of the outer case 1 from above against the resilient force of the slider springs 4. As long as no outer force is imparted to the slider 3, the slider 3 is held at the stationary position as shown in FIG. 2 which represents a locked state of the magnet card type lock.

As shown in FIG. 1, a projection 6 is integrally projected outwardly from the left-hand end surface of the slider 3 as seen in the drawing. When a magnet card 17 to be described later is inserted through the slits for the purpose of unlocking the magnet card type lock, the projection 6 projecting outward of a groove 7 of the outer case is brought into engagement with a locking mechanism (not shown) to actuate the same. To avoid interference of the projection 6 with the groove 7 when the magnet card type lock is unlocked, the groove 7 is dimensioned to have a depth greater than a thickness of the projection 6.

The outer case 1 and the slider 3 are formed with a plurality of tumbler holes 8 (five tumbler holes in the embodiment shown) which extend through a shear line (or shear plane) defined by a slidable surface 10 between the right-hand side wall of the slider 3 which is relatively thin and the right-hand side wall of the outer case 1 which is relatively thick. The tumbler holes 8 are arranged in a predetermined spaced relationship along the longitudinal direction of the slider 3 as shown in FIG. 1.

As is apparent from FIG. 1 and FIG. 2, each tumbler hole 8 is formed by an axial aligned combination of a circular recess formed the slider 3 and a through hole formed through the outer case and extending to the right-hand side wall of a tumbler cover 9. As shown, the tumbler cover 9 has an inverted L-shaped sectional contour and is firmly placed on the right-hand side wall of the outer case 1. Thus, the opposite ends of each tumbler hole 8 are respectively closed by the slider 3 and the tumbler cover 9. As shown in FIG. 2, each tumbler hole 8 is formed such that the circular recess formed in the slider 3 is dimensioned to have a diameter slightly larger than that of the through hole in the outer case 1 so that a stepped portion is formed along the shear line 10. However, it should be noted that formation of the stepped portion in each tumbler hole 8 in this manner is not essential in carrying out the present invention.

A magnet tumbler 11 and a tumbler spring 12 in the form of a compression spring are received in each tumbler hole 8. Thus, the magnet tumbler 11 is normally biased toward the lock hole slit 2, i.e. in the leftward direction as seen in FIG. 2, by the resilient force of the tumbler spring 12.

As shown in FIG. 2, an axial length of the portion of the tumbler hole 8 formed through the outer case 1 is dimensioned to be greater than an axial depth of the portion of the tumbler hole 8 formed in the slide 3. Thus, as long as no outer force is imparted to the magnet tumbler 11, the latter is bridged between the outer case 1 and the slider 3 with the shear line 10 located therebetween.

Each magnet tumbler 11 is magnetized in the axial direction of the tumbler hole 8.

Figure 3:
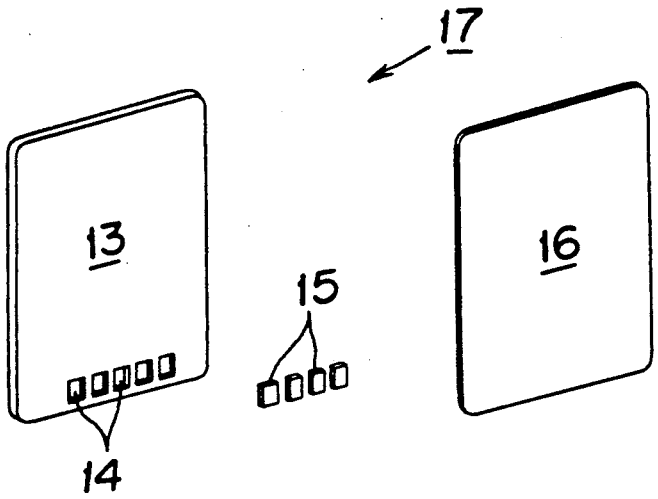
FIG. 3 is an exploded perspective view of a magnet card usable with the magnet card type lock shown in FIG. 1, particularly illustrating components constituting the magnet card in a disassembled state.

Next, the magnet card 17 will be described in detail below with reference to FIG. 3. A main body 13 of the magnet card 17 which serves as a fellow key is composed of a non-magnetic material such as a synthetic resin or the like in the form of a plate. A plurality of recesses 14 are formed on the fore end part of the magnet card 1 as seen in the direction of insertion of the same, and each of the recesses 14 has fixedly filled therein a permanent magnet 15 magnetized in the direction of a thickness of the magnet card 17. In addition, a thin seal plate 16 is adhesively secured to the main body 13 to thereby to constitute a single magnetic card.

Figure 4:
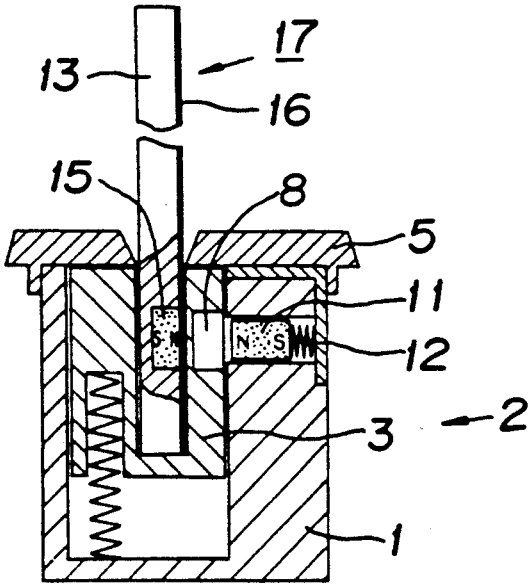
FIG. 4 is a vertical sectional view of the magnet card type lock shown in FIG. 1, particularly illustrating the magnet card shown in FIG. 3 serving as a fellow key and inserted into a key hole slit on a slider for the purpose of unlocking the lock.

As shown in FIG. 4, the position where each permanent magnet 15 is embedded in the magnet card 17 is determined such that when the magnet card 17 is inserted into the key hole slit 2 in the downward direction, the permanent magnet 15 is correctly aligned with the corresponding magnet tumbler 11 in the tumbler hole 8. It should be added that all the permanent magnets 15 are magnetized in such a manner that they are located opposite to corresponding magnet tumblers 11 with the same magnetic pole.

For this reason, when the magnet card 17 serving as a fellow key is inserted into the key hole slit 2, all the magnet tumblers 11 are displaced away from the magnet card 17 against the resilient force of the tumbler springs 12 by the magnetic repulsive force appearing between the permanent magnet 15 and the magnet tumbler 11, whereby they are retracted behind the shear line 10, as shown in FIG. 4.

Figure 5:
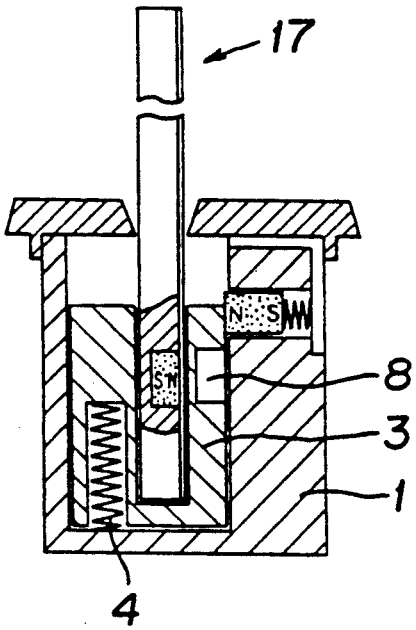
FIG. 5 is a vertical sectional view of the magnet card lock similar to FIG. 4, particularly illustrating the magnet card being pushed further into the lock until the lock is completely unlocked.

As a result, the slider 3 is released from its engagement with the outer case 1. Thus, as the magnetic card 17 is pushed further in the same direction, the slider 3 is increasingly displaced in the cavity of the case 1 against the resilient force of the slider springs 4, as shown in FIG. 5. At this time, since the projection 6 is displaced together with the slider 3, the locking mechanism (not shown) is actuated by the projection 6 when the latter comes in contact with the former.

When a user's hand is disengaged from the magnet card 17 or he releases his fingers from the magnet card 17, the slider 3 is restored to the original position shown in FIG. 4 by the action of the slider springs 4.

Subsequently, when the magnet card 17 is taken out of the key hole slit 2, the respective magnet tumblers 11 are restored to their original positions shown in FIG. 2 by the action of the tumbler springs 12 so that they are bridged between the outer case 1 and the slider 3 with the shear line 10 located therebetween.

Although the locking mechanism does not form any part of the present invention, an example of the locking mechanism to be actuated by the magnet card type lock of the present invention will be described below with respect to a magnet card type lock of the present invention equipped on a trunk case, with reference to FIG. 6 to FIG. 9.

Figure 6:
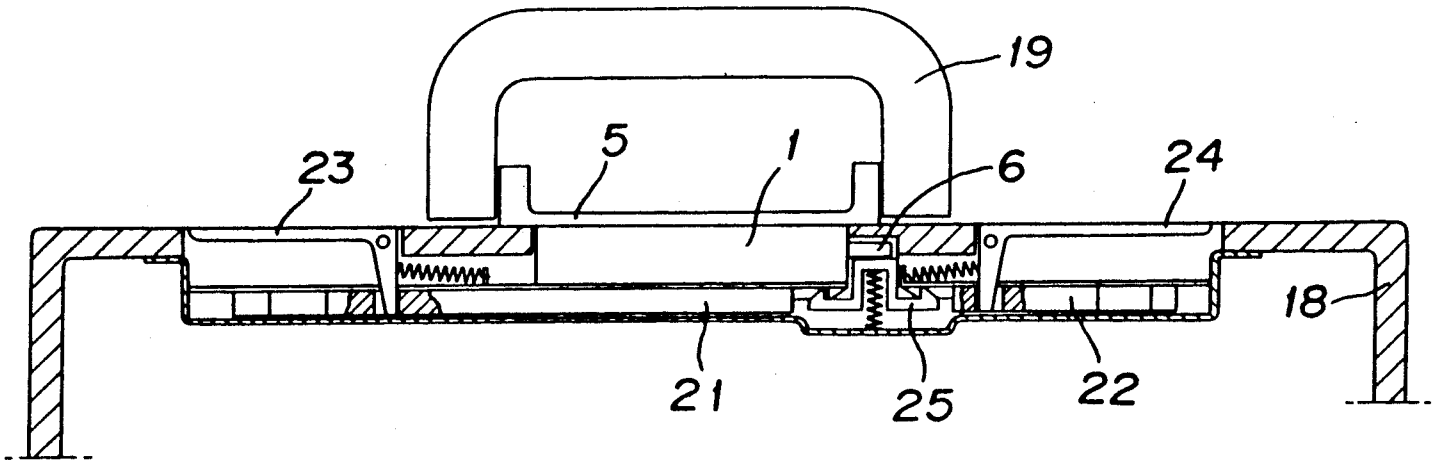
FIG. 6 is a fragmentary sectional view of a trunk case for which the magnet card type lock in accordance with the first embodiment of the present invention is employed and wherein a locking mechanism operatively associated with the magnet card type lock in accordance with the first embodiment of the present invention is held in a locked state.
Figure 8:
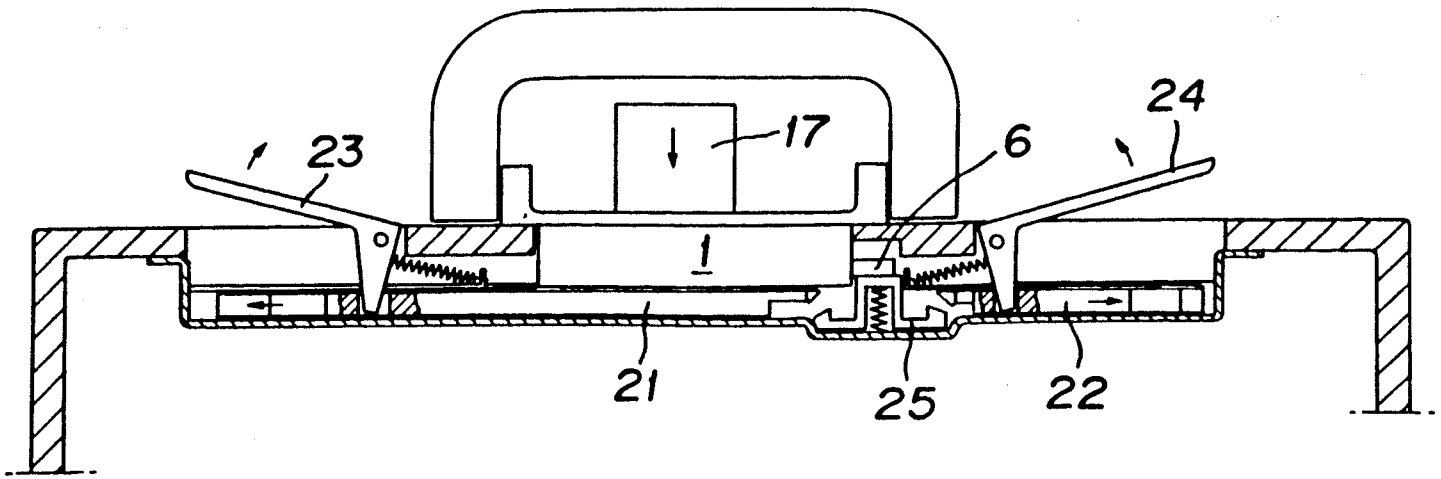
FIG. 8 is a fragmentary sectional view of a trunk case similar to FIG. 6, particularly illustrating the locking mechanism released from the locked state by actuation of the magnet card type lock in accordance with the first embodiment of the present invention.

In FIG. 6, reference numeral 1 designates the outer case magnet card type. The outer case 1 is firmly secured to one shell 18 of the trunk case with the aid of a decorative plate 5 (as shown in FIG. 1). A handle 19 is pivotably attached to the decorative plate 5.

Since the locking mechanism to be described below is well known in the art, it will be only briefly described for the purpose of simplification. Longitudinally displaceable first and second engagement rods 21 and 22 are arranged below the outer case 1 and are engaged with first and second set levers 23 and 24 both of which have an L-shaped contour. Since the first set lever 23 is normally pivotably biased by a spring in the clockwise direction and the second set lever 24 is likewise normally pivotably biased by a spring in the counterclockwise direction as seen FIG. 6, the first engagement rod 21 is normally biased in the leftward direction and the second engagement rod 22 is likewise normally biased in the rightward direction as seen in FIG. 6. As long as the magnet card type lock equipped on the trunk case is kept in a locked state as shown in FIG. 6, the inner ends of both the engagement rods 21 and 22 are engaged with a control pawls 25 to thereby assume their positions shown in FIG. 6. The control pawl 25 is normally biased in the upward direction by a spring to come in contact with the lower surface of the projection 6 of the magnet card type lock which has been described above with reference to FIG. 1 to FIG. 5.

Figure 7:
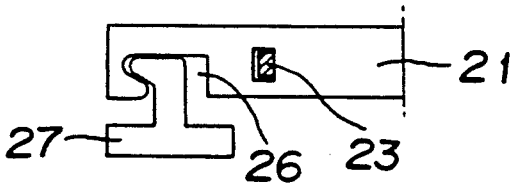
FIG. 7 is an enlarged fragmentary plan view of a locking mechanism equipped on the trunk case shown in FIG. 6, particularly illustrating that an engagement rod engaged with an engagement pawl.

As shown in FIG. 7, an engagement recess 26 is formed at each of the outer ends of the engagement rods 21 and 22. While the locking mechanism equipped on the trunk case is kept in the locked state shown in FIG. 6 and FIG. 7, a hook-shaped engagement pawl 27 extending from the other shell of the trunk case is received in the engagement recess 26. This prevents the trunk case from being opened by any other person.

Figure 9:
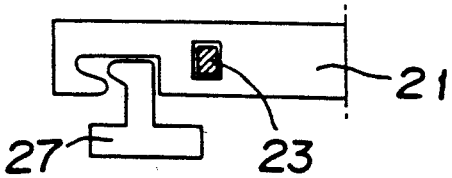
FIG. 9 is an enlarged fragmentary view of the locking mechanism similar to FIG. 7, particularly illustrating that the engagement rod is disengaged from the engagement pawl when the locking mechanism is released from the locked state by actuation of the magnet card type lock in accordance with the first embodiment of the present invention.

When the magnetic card 17 is inserted into the key hole slit 2 in the above-described manner for the purpose of opening the trunk case, the projection 6 is pushed in the downward direction to thereby lower the control pawls 25, causing the first and second engagement rods 21 and 22 to be released from the engaged state. Subsequently, the set levers 23 and 24 are pivoted upwardly in the directions shown by arrows in FIG. 8 by the action of the springs so that the first and second engagement rods 21 and 22 are moved away from each other. As a result, the positional relationship of the engagement rod 21 (22) relative to the engagement pawl 27 is changed, as shown in FIG. 9. Now, an owner of the trunk case is ready to open it. On the contrary, when the trunk case is closed in a locked state, the set levers 23 and 24 are pivoted in the direction opposite to the direction of the arrows in FIG. 8 by hand.

Next, preparation of a specific key difference among a number of magnet card type locks of the present invention will briefly be described below.

Some tumbler holes 8 are selected from all the tumbler holes 8 (five tumbler holes in the embodiment shown) so that only the selected number of tumbler holes 8 are provided with magnet tumblers 11 and springs 12 in the same manner as the conventional magnet tumbler type lock. It should be added that all the tumbler holes 8 may be selected for the same purpose as mentioned above. In the case shown in FIG. 1, four tumbler holes 8 as counted from the front side are selected. In practical use, there are available a plurality of patterns of arrangement of the tumbler holes 8. In addition, only with respect to a single pattern of arrangement of a plurality of tumbler holes 8, a plurality of patterns for combining a plurality of magnetic poles with each other are practically available depending on whether a north pole of each magnet tumbler 11 is oriented in the inward direction or in the outward direction. As will be apparent from the above description, the available number of specific key differences can be represented by the product obtained by multiplying the number of patterns of the aforementioned combination of magnetic poles by the number of patterns of arrangement of the plurality of tumbler holes 8.

Figure 10:
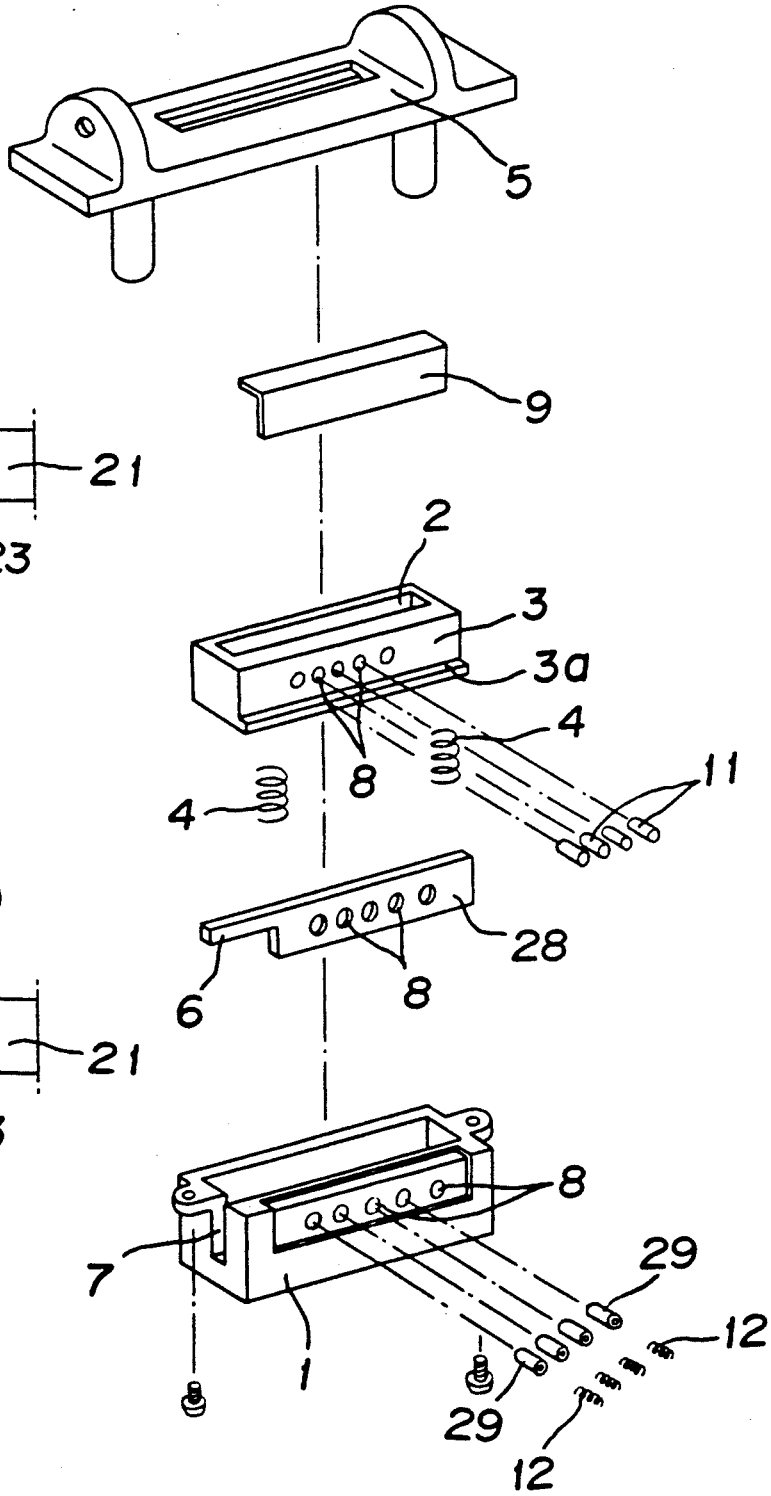
FIG. 10 is an exploded perspective view of a magnet card type lock in accordance with a second embodiment of the present invention, particularly illustrating essential components constituting the lock in a disassembled state.

Next, a magnet card type lock in accordance with a second embodiment of the present invention will be described below with reference to FIG. 10 and FIG. 11. Since the structure of the magnet card type lock shown in FIG. 10 is substantially similar to that of the magnet card type lock shown in FIG. 1, components which are the same as or similar to those shown in FIG. 1 are represented by same reference numerals. For the purpose of simplification, only features of the magnet card type lock shown in FIG. 10 which differs from that shown in FIG. 1 are described in the following discussion.

Figure 11:
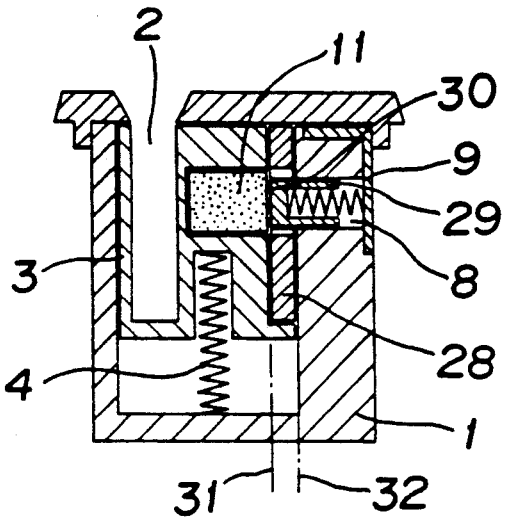
FIG. 11 is a vertical sectional view of the magnet card type lock shown in FIG. 10, particularly illustrating that the lock is held in a locked state.

In FIG. 10 and FIG. 11, reference numeral 28 designates a projection plate. The projection plate 28 is a plate which is slidably inserted between a slider 3 and an inner wall surface of the right-hand side wall of an outer case 1 as seen in the drawings to slidably move in the direction of slidable movement of the slider 3 (i.e., in the upward/downward direction). As is apparent to move from the drawings, the projection plate 28 is arranged to move independently of the slider 3 and the case 1. A plurality of tumbler holes 8 (five tumbler holes in the embodiment shown) are formed on the projection plate 28 in a spaced relationship along the longitudinal direction. A projection 6 integrated with the projection plate 28 is received in a projection groove 7 and projects outwardly of the outer case 1. In this embodiment, a stepped portion 3*a* is formed at the outer lower end part of the slider 3, and the projection plate 28 is placed on the stepped portion 3*a* of the slider 3. Obviously, formation of the stepped portion 3*a* is not essential for carrying out the present invention.

Since the projection plate 28 is inserted between the case 1 and the slider 3 so as to slidably move independently of them, slidable surfaces are formed on the opposite sides of the projection plate 28. Thus, the slidable surface between the projection plate 28 and the slider 3 is defines a first shear line (or shear plane) 31, and the slidable surface between the projection plate 28 and the outer case 1 is defines a second shear line (or shear plane) 33 (see FIG. 11).

The respective tumbler holes 8 are formed through the first and second shear lines 31 and 32 at and are disposed substantially right angle relative thereto. A magnet tumbler 11, a pin tumbler 29 and a tumbler spring 12 are received in each of a plurality of selected tumbler holes 8 (four tumbler holes selected in the embodiment shown) in accordance with the order as seen from the key hole slit 2 side. The arrangement of the tumbler springs 12 allows the magnet tumblers 11 and the pin tumblers 29 to be normally biased toward the key hole slit 2. Each magnet tumbler 11 is magnetized in the axial direction of the tumbler hole 8 (in the leftward/rightward direction in FIG. 11) in the same manner as the magnet card type lock in accordance with the first embodiment of the present invention which has been described above with reference to FIG. 1 to FIG. 5. In addition, a non-magnetic metallic material such as stainless steel, brass or the like is preferably employable as a raw material for the pin tumblers 29.

A length of each magnet tumbler 11 and a length of each pin tumbler 29 are dimensioned in conjunction with a length of each tumbler hole 8 and a thickness of the projection plate 28. As long as no outer force is imparted to the magnet tumblers 11, a contact surface 30 between each magnet tumbler 11 and each pin tumbler 29 (hereinafter referred to as a tumbler contact surface) is correctly aligned with the first shear line 31, as shown in FIG. 11. When a magnet card 17 to serve as a fellow key is inserted into the key hole slit 2 and the magnet tumbler 11 is moved away from the magnet card 17 by the magnetic repulsive force created between the permanent magnet 15 and the magnet tumbler, the tumbler contact surface 30 is correctly aligned with the second shear line 32, as shown in FIG. 12.

Figure 13:
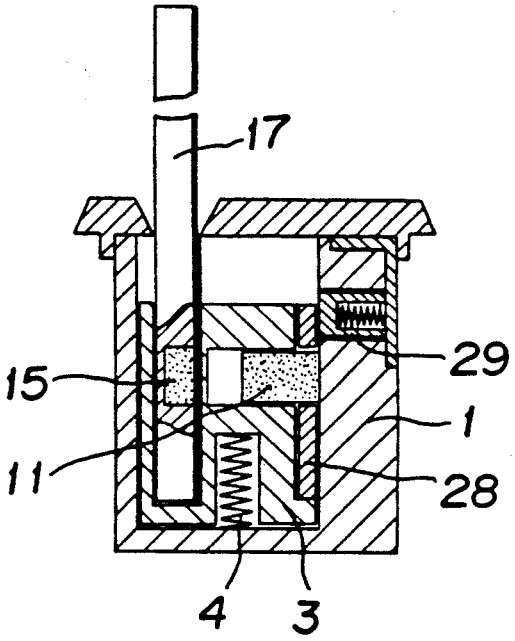
FIG. 13 is a vertical sectional view of the magnet card type lock similar to FIG. 12, particularly illustrating the magnet card pushed further into the lock until the lock is completely unlocked.
Figure 12:
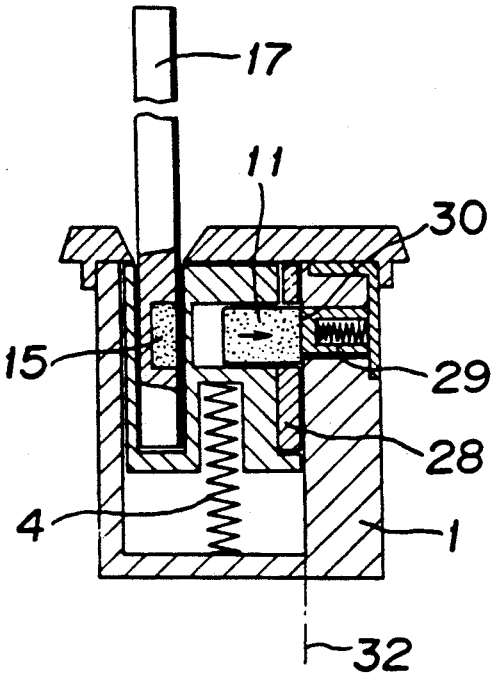
FIG. 12 is a vertical sectional view of the magnet card type lock shown in FIG. 10, particularly illustrating a magnet card serving as a fellow key and inserted into a key hole slit for the purpose of unlocking the lock.

Thus, when the magnet card 17 is inserted into the slit 2, all the tumbler contact surfaces 30 are correctly aligned with the second shear line (see FIG. 12). As the magnet card 17 is pushed further in the downward direction, the slider 3 and the projection plate 28 are lowered together exclusive of the pin tumblers 29 which are still immovably held in the tumbler hole 8, as shown in FIG. 13. Thus, the projection 6 is likewise lowered together with the slider 3 and the projection plate 28 to come in contact with a locking mechanism (not shown), whereby the locking mechanism is controllably actuated.

If a different kind of magnet card 17 failing to serve as a fellow key is inserted into the slit 2 for the purpose of maliciously unlocking the magnet card type lock, it is considered that there arise two cases, one of them being a case where some of the magnet tumblers are displaced in the above-described manner but at least one magnet tumbler is still immovably held and the other one being a case where all the magnet tumblers are immovably held.

In the former case, since at least one magnet tumbler 11 is bridged between the slider 3 and the projection plate 28 with the first shear line 31 located therebetween (see FIG. 12) and at least one pin tumbler 29 is bridged between the projection plate 28 and the outer case 1 with the second shear line 32 located therebetween (see FIG. 11), the slider 3 and the projection plate 28 can not be displaced no matter how the magnet card 17 is forcibly pushed in the downward direction.

Figure 14:
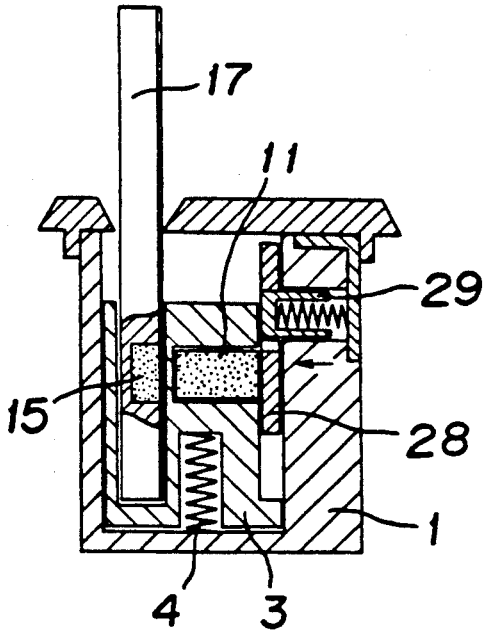
FIG. 14 is a vertical sectional view of the magnet card type lock similar to FIG. 13, particularly illustrating a slider displaced together with all magnet tumblers in the downward direction by a different kind of magnet card exclusive of a projection plate and pin tumblers which are still immovably held in an outer case, whereby the magnet card type lock fails to be unlocked.

On the other hand, in the latter case, since all the tumbler contact surfaces 30 are correctly aligned with the first shear line 31 (see FIG. 14), only the slider 3 is displaced in the downward direction exclusive of the projection plate 28 which is still immovably held in the tumbler hole 8. Thus, the locking mechanism can not be actuated because the projection plate 28 is not displaced downwardly. Things are same in a case where a card-shaped steel sheet is inserted into the key hole slit 2 and it is then subjected to intense hammering for the purpose of breaking the magnet card type lock for unlocking the same.

As described above, according to the present invention, a magnet card type lock is constructed such that a key hole slit is formed in a slider adapted to be engaged with a locking mechanism via a projection plate and a locking/unlocking operation is performed by displacing a magnet card in the downward/upward direction. Thus, it is unnecessary to design and construct the slider with large dimensions in a complicated manner, thereby resulting in the magnetic card type lock being designed and constructed with smaller dimensions.

To actuate the slider including a projection or a projection plate, a depressing force given by a user's fingers is applied to magnet tumblers via the magnet card and the slider. However, since only a slight depressing force is required, there is no possibility that any excessively large force will be imparted to the magnet tumblers.

Especially with respect to the magnet card type lock in accordance with the second embodiment of the present invention, even when a card-shaped steel sheet or the like is inserted into the key hole slit and an intense hammering force is then imparted to it by an unauthorized person for the purpose of violently breaking the magnet card type lock to unlocking it, only the slider will be displaced. This displacement of the slider will prove useless, and no shearing force will be imparted to the magnet tumblers and the pin tumblers. Thus, there is no possibility that the magnet card type lock will be unlocked in this manner.

Additionally, since a locking/unlocking operation is achieved by merely inserting the magnet card into the key hole slit and then pushing it further, the magnet card type lock of the present invention has an advantageous effect that it can be used easily, simply and conveniently by any user.

While the present invention has been described above only with respect to two preferred embodiments thereof, it should of course be understood that the present invention should not be limited only to these embodiments, and that various changes or modifications may be made without departure from the scope of the invention as defined by the appended claims.

What is claimed is:

1. A magnet card type lock comprising an outer case having a vertically extending opening formed therein;

a slider vertically slidably mounted in said outer case, said slider having a key hole slit formed therein for receipt of a key card;

first spring means for biasing said slider upwardly;

an engagement member fixed to said outer case for preventing upward movement of said slider beyond a predetermined location;

a projection plate vertically slidably mounted in said outer case between a vertical contact surface of said slider and a vertical contact surface of said outer case for vertical sliding movement relative to both said outer case and said slider;

a projection fixed to said projection plate and extending out of said outer case through said vertically extending opening;

wherein a plurality of substantially horizontal slider tumbler holes are formed in said slider and open through said contact surface of said slider, a plurality of substantially horizontal projection plate tumbler holes are formed through said projection plate, and a plurality of substantially horizontal outer case tumbler holes are formed in said outer case and open through said contact surface of said outer case;

wherein said slider tumbler holes, said projection plate tumbler holes, and said outer case tumbler holes are respectively located in said slider, said projection plate, and said outer case such that, when said slider and said projection plate are in predetermined vertically aligned positions, said slider tumbler holes, said projection plate tumbler holes, and said outer case tumbler holes are in registry with one another;

wherein a plurality of magnet tumblers are respectively slidably mounted in at least some of said plurality of slider tumbler holes in a predetermined arrangement, said magnet tumblers having contact end surfaces which face toward said contact surface of said outer case;

wherein a plurality of pin tumblers are respectively slidably mounted in at least some of said plurality of outer case tumbler holes which correspond to said at least some of said plurality of slider tumbler holes, said pin tumblers having contact end surfaces which face toward said contact surface of said slider and which are adapted to contact said contact end surfaces of said magnet tumblers, respectively;

wherein second spring means are provided for biasing said pin tumblers and said magnet tumblers toward said key hole slit formed in said slider such that, when said slider tumbler holes, said projection plate tumbler holes, and said outer case tumbler holes are in registry with one another, said magnet tumblers are depressed into said slider tumbler holes, respectively, such that said contact end surfaces of said magnet tumblers are substantially vertically aligned with said contact surface of said slider, and said pin tumblers extend from within said outer case tumbler holes into said projection plate tumbler holes, respectively, such that said contact end surfaces of said pin tumblers are in contact with said contact end surfaces of said magnet tumblers, respectively, and are substantially vertically aligned with said contact surface of said slider, to thereby maintain said projection plate substantially immovable relative to said outer case and allow said slider to move downwardly relative to both said outer case and said projection plate; and wherein said plurality of magnet tumblers in said predetermined arrangement comprise a means for sliding said magnet tumblers and said pin tumblers against a biasing force of said second spring means when a key card having a magnet arrangement corresponding to said predetermined arrangement of said magnet tumblers is inserted into said key hole slit, such that said contact end surfaces of said magnet tumblers and said contact end surfaces of said pin tumblers are moved into substantial alignment with said contact surface of said outer case, to thereby allow said slider to be moved downwardly against a biasing force of said first spring means and cause said projection plate to be moved downwardly along with said slider when said slider is moved downwardly.

2. A magnet card type lock as recited in claim 1, wherein said outer case tumbler holes are formed completely through a wall of said outer case; and an L-shaped tumbler cover is fixed to said wall of said outer case to cover outer ends of said outer case tumbler holes.

3. A magnet card type lock as recited in claim 1, wherein said slider tumbler holes and said projection plate tumbler holes are formed with a diameter greater than a diameter of said outer case tumbler holes.

4. A magnet card type lock as recited in claim 1, wherein said outer case is box-shaped.

* * * * *